United States Patent [19]

Muellers

[11] Patent Number: 4,875,510

[45] Date of Patent: Oct. 24, 1989

[54] DOVETAIL MACHINE

[76] Inventor: John H. Muellers, 1540 Hastings Crescent, SE., Calgary, Alberta, Canada, T2G 4E1

[21] Appl. No.: 312,176

[22] Filed: Feb. 21, 1989

[51] Int. Cl.[4] ..... B27M 3/00

[52] U.S. Cl. ..... 144/145 A; 144/87; 144/144.5 R

[58] Field of Search ..... 144/85, 87, 144.5, 145 R, 144/145 A, 372

[56] References Cited

U.S. PATENT DOCUMENTS

| | | | |
|---|---|---|---|
| 478,544 | 7/1892 | Cordesman et al. . | |
| 610,272 | 10/1898 | Lindwall . | |
| 2,225,263 | 12/1940 | Farrell | 144/87 |
| 2,299,602 | 10/1942 | Teague | 144/87 |
| 2,764,191 | 10/1956 | Hartman . | |
| 2,893,449 | 7/1959 | Hadnagy . | |
| 3,109,466 | 11/1963 | Jones | 144/144.5 |
| 3,800,840 | 4/1974 | McCord, Jr. . | |
| 4,163,465 | 8/1979 | Strong . | |
| 4,632,159 | 12/1986 | Glasgo . | |
| 4,809,755 | 3/1989 | Pontikas | 144/144.5 |

*Primary Examiner*—W. Donald Bray

*Attorney, Agent, or Firm*—Murray E. Thrift; Stanley G. Ade; Adrain D. Battison

[57] ABSTRACT

A dovetailing jig has a base with a flat top surface notched along the back edge. A back on the jig has a flat front surface that is positioned above and at the rear of the top surface of the base while two side plates provide confronting flat side faces. Two clamping cylinders extend between the side plates to clamp work pieces to the top surface of the base and to the front surface of the back. In use, the jig slides on a bench surface equipped with a stationary router blade.

17 Claims, 3 Drawing Sheets

DOVETAIL MACHINE

FIELD OF THE INVENTION

The present invention relates to a dovetail jig and more particularly to a jig for use with a fixed dovetailing bit projecting from a bench surface.

BACKGROUND

Various templates and machines have been designed in the past for producing dovetail joints. Templates are generally designed to clamp work to a bench so that a hand held router can be used to produce the desired dovetail formations in the ends of the work pieces. Dovetail machines are more comprehensive and include stationary bits, substantial clamping arrangements and mechanisms for sequentially moving the clamped work pieces towards and away from the router bit, while simultaneously shifting them stepwise to one side.

The present invention is concerned with a manual jig that may be used with a stationary, bench-mounted router bit and that provides for the rapid and convenient production of dovetail joints in small work pieces, for example, drawer components.

SUMMARY

According to the present invention there is provided a dovetailing jig for use with a fixed dovetailing bit projecting from a bench surface, said jig comprising:

a base having a flat bottom surface for supporting the jig on the bench surface, a flat top surface for supporting a first work piece and a plurality of notches spaced along a back edge of the base for guiding the jig onto the bit as the jig slides on the bench surface;

a back having a flat front surface and a bottom edge;

means securing the back to the base with the flat front surface of the back perpendicular to the top surface of the base for supporting a second work piece, and with the bottom edge spaced above the top surface of the base;

a base clamp comprising a first elongated member positioned above and parallel to the top surface of the base and means mounting the first elongated member for selective movement towards and away from the top surface thereby selectively to hold the first work piece on the top surface;

a back clamp comprising a second elongated member positioned in front of and parallel to the front surface and means mounting the second elongated member for selective movement towards and away from the front surface thereby selectively holding the second work piece on the front surface.

The jig will accept one or more work pieces vertically, along the front face of the back, with its end resting on the base, where it is notched. A second work piece can then be inserted on top of the base to butt against the front face of the first work piece. A simple manipulation clamps the work pieces in place and the jig can then be slid over the work bench surface manually to produce the desired dovetail joint in the work pieces.

BRIEF DESCRIPTION OF THE DRAWINGS

In the accompanying drawings, which illustrate an exemplary embodiment of the present invention.

DETAILED DESCRIPTION

Figure 1:
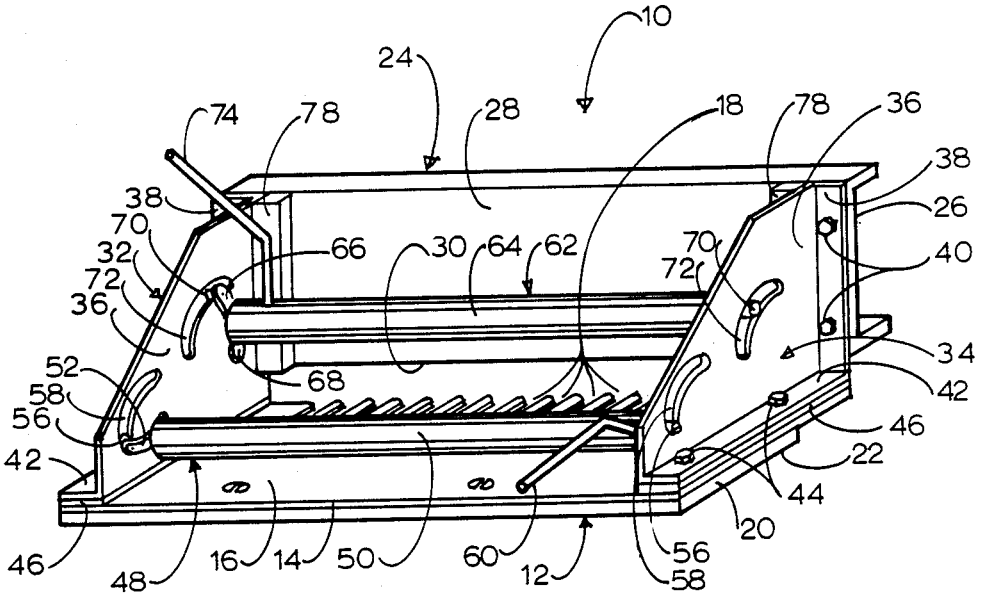
FIG. 1 is an isometric view of a jig according to the present invention.
Figure 2:
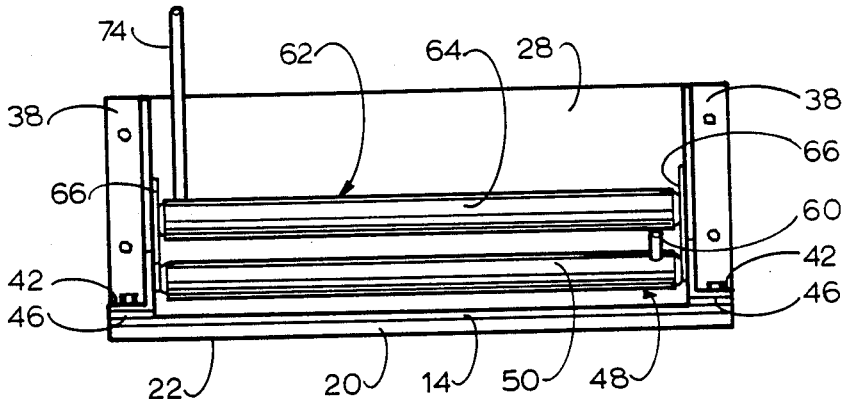
FIG. 2 is a front elevation of the jig.
Figure 3:
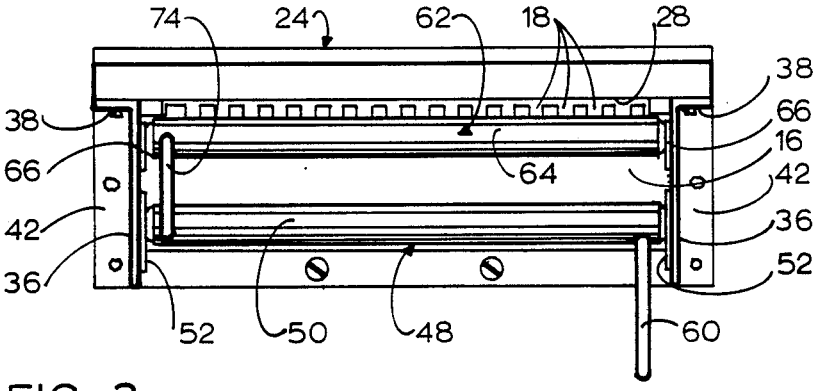
FIG. 3 is a plan view of the jig.

Referring to the accompanying drawings, there is illustrated a dovetailing jig 10 with a composite base 12. The base includes a base plate 14 with a flat top surface 16 and a series of notches 18 extending into its back edge. Secured to the bottom of the base plate 14 is a spacer plate 20 that extends from side to side of the jig and from the front to a position forward of the notches 18. The bottom surface 22 of the plate 20 supports the jig on a bench surface.

The jig also includes a back 24 that is formed from a channel section 26. The back face of the channel web provides a front surface 28 of the back, while the lower flange of the channel defines the bottom edge 30 of the back.

The base and back are connected to one another by two sides 32 and 34. Each side consists of a flat plate 36 with a back flange 38 that is secured to the front surface 28 of the back 24 with a pair of machine screws 40. A base flange 42 along the bottom edge of the plate is secured to the base 12 with a pair of machine screws 44. A spacer 46 is located between the flange 42 and the base plate 14.

The flanges 38 and 42 project to the outside of the plate 36. The base, back and sides are connected so that the top surface 16, bottom surface 22 and the inside surfaces of the sides 32 and 34 are mutually perpendicular.

Work pieces are held on the top surface 16 of the base 12 with a base clamp 48. This includes a cylinder 50 that extends between the sides 32 and 34. The cylinder is mounted to the center of a pivot arm 52 at either end. The pivot arm has a fixed pivot 54 (FIG. 6) at one end. The other end of the pivot arm carries a follower 56 that rides in arcuate slot 58 in the side plate 36. An arm 60 is secured to the cylinder adjacent one end and projects upwardly and forwardly from the cylinder. The movement of the arm 60 will move the cylinder 50 towards and away from the top surface 16 to hold or release work pieces on that surface.

A similar back clamp 62 is used to hold work pieces against the front surface 28 of the back 24. This consists of a cylinder 64 connected at its opposite ends to pivot arm 66 so that one end of each pivot arm is connected to the adjacent side plate 36 by a fixed pivot 68. The opposite end of the arm carries a follower 70 that rides in an arcuate slot 72 in the side plate. An arm 74 projects upwardly and the front from the cylinder to allow the manipulation of the clamp so that cylinder 64 can be moved towards and away from the front surface 28.

Along the front surface 28 of back 24, and along the inside face of each side plate 36 is a spacer 78 that extends along the back surface from the side plate a distance equal to the width of one of the fingers between the notches 18.

In use, a work piece is placed in the jig, along the front face of the back, with its side edge abutting the spacer 78 and its end resting on the top of the base plate 14. The work piece 80 is clamped in place by raising the arm 74 of the back clamp 62 to bring the cylinder 64 into engagement with the work piece. A second work piece 82 is then placed on the top surface 16, with its side edge abutting the inside of the side plate 36 and its end abutting the front face of the work piece 80. The work piece 82 is then clamped in place by pulling the arm 60 downwardly to bring the cylinder 50 into clamping engagement with the top of the work piece.

Figure 6:
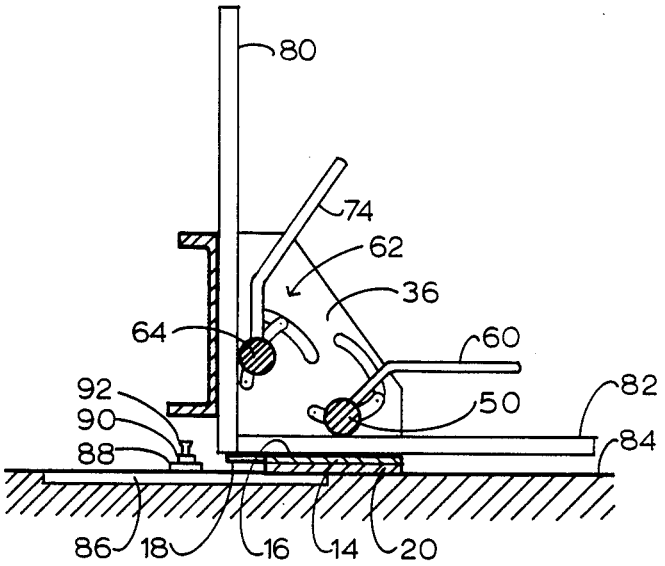
FIG. 6 is a section along line VI—VI, showing work pieces inserted in the jig.

The jig is used on a bench 84 equipped with a fixed router attachment as illustrated in FIG. 6, this includes a base plate 86 set into the surface of the bench, a boss 88 projecting from the middle of the base plate, with the same height as the spacer plate 20 of jig base 12. Projecting from the center of the boss 88 is a guide cylinder 90 with a diameter equal to the width of the notches 18 in the base 12. Projecting from the center of the guide cylinder 90 is a router bit 92.

Figure 4:
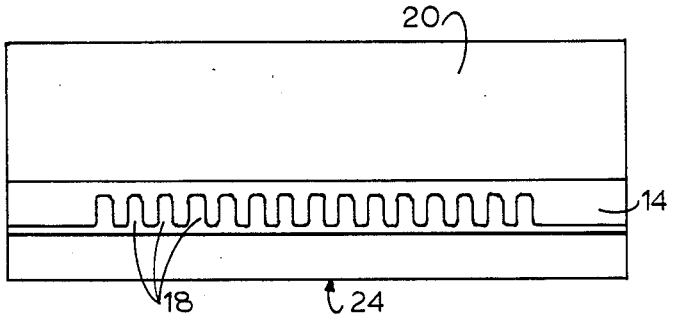
FIG. 4 is a bottom view of the jig.
Figure 5:
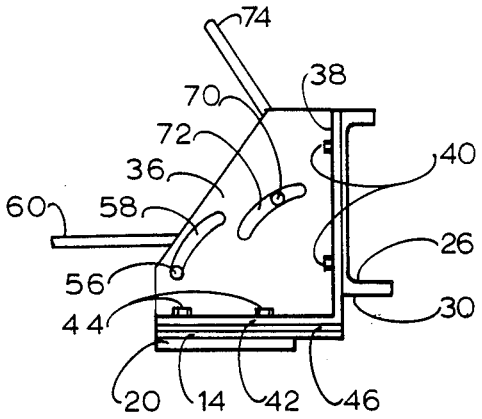
FIG. 5 is a right side elevation of the jig.

The jig is then slid forward against the router bit so that the guide cylinder 90 will follow the contour of the notched back edge of the base plate 14, cutting dovetail grooves in the end of work piece 80 and the face of work piece 82. As illustrated especially in FIG. 4, the back edge of the base plate 14 is spaced slightly forwardly of the front face of the back 24. This allows an undercutting of the work piece 80 so that in the completed joint, the joint will be completely hidden on the inside.

Figure 7:
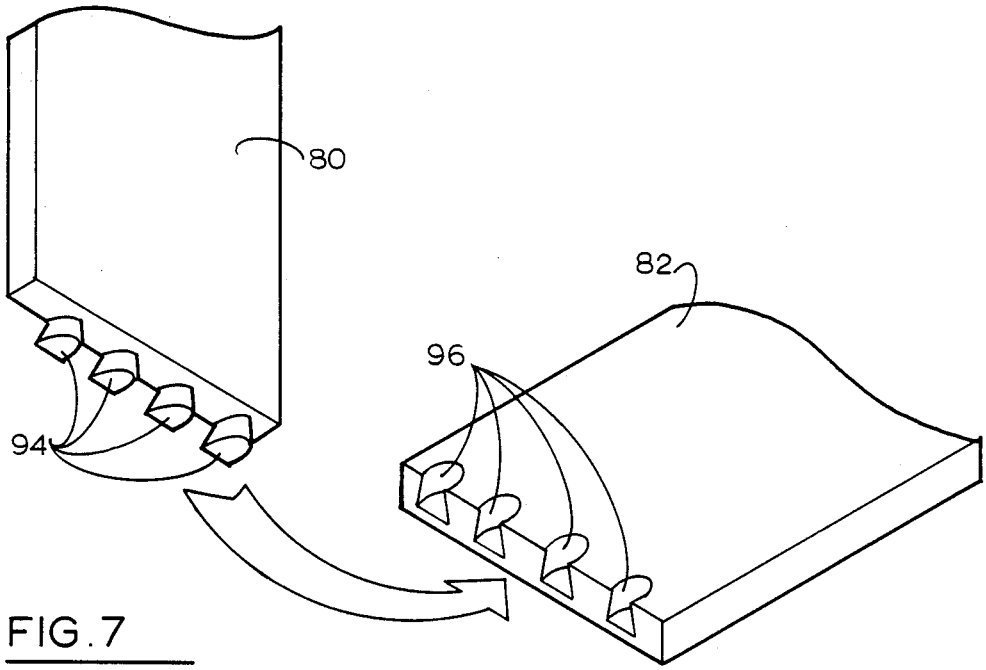
FIG. 7 is an isometric view of two finished work pieces.

The completed cut is illustrated in FIG. 7, where the work piece 80 is shown turned through 180° about its vertical extent from the depiction in FIG. 6, and likewise, the work piece 82 has been rotated through 180° about its longitudinal extent. The fingers 94 side endwise into the grooves 96 in the end of the work piece 82.

Where desired, it is possible to insert four work pieces into the jig, two on each side, for increased production, speed and convenience.

While one embodiment of the present invention has been described in the foregoing, it is to be understood that other embodiments are possible within the scope of the invention. The invention is to be considered limited solely by the scope of the appended claims.

I claim:

1. A dovetailing jig for use with a fixed dovetailing bit projecting from a bench surface, said jig comprising:

a base having a flat bottom surface for supporting the jig on the bench surface, a flat top surface for supporting a first work piece and a plurality of notches spaced along a back edge of the base for guiding the jig onto the bit as the jig slides on the bench surface;

a back having a flat front surface and a bottom edge;

means securing the back to the base with the flat front surface of the back perpendicular to the top surface of the base for supporting a second work piece, and with the bottom edge spaced above the top surface of the base;

a base clamp comprising a first elongated member positioned above and parallel to the top surface of the base and means mounting the first elongated member for selective movement towards and away from the top surface thereby selectively to hold the first work piece on the top surface;

a back clamp comprising a second elongated member positioned in front of and parallel to the front surface and means mounting the second elongated member for selective movement towards and away from the front surface thereby selectively holding the second work piece on the front surface.

2. A jig according to claim 1 wherein the means mounting the back on the base includes at least one side having a flat side surface perpendicular to the top and front surfaces for engaging a side edge of at least one of the work pieces.

3. A jig according to claim 2 including a spacer extending along the side surface for engaging a side edge of said at least one of the work pieces and spacing said side edge a predetermined distance from the side surface.

4. A jig according to claim 3 wherein the spacer extends along the front surface of the back.

5. A jig according to claim 1 wherein the means for securing the back to the base include two sides spaced apart to provide two flat side surfaces confronting one another and perpendicular to the top and front surfaces for engaging side edges of respective work pieces.

6. A jig according to claim 5 including two spacers extending along the respective side surfaces and along the front surface of the back for engaging the side edges of respective second work pieces.

7. A jig according to claim 1 wherein the first elongated member comprises a cylinder parallel to the base support surface.

8. A jig according to claim 7 wherein the means mounting the first elongated member comprise a pair of pivot arms, each pivotally connected to a fixed location on the jig and connected to a respective end of the cylinder.

9. A jig according to claim 8 wherein each pivot arm is pivotally connected to the respective fixed location on the jig at one end of the pivot arm, and including means for guiding the opposite end of each pivot arm for movement through an arc, the associated end of the cylinder being connected to the pivot arm intermediate the ends thereof.

10. A jig according to claim 9 including a lever arm secured to the cylinder and projecting upwardly and forwardly therefrom.

11. A jig according to claim 1 wherein the second elongated member of the back clamp comprises a cylinder parallel to the front surface.

12. A jig according to claim 11 wherein the means mounting the second elongated member comprise a pair of pivot arms each pivotally connected to a fixed location on the jig and connected to a respective end of the cylinder.

13. A jig according to claim 12 wherein each pivot arm is pivotally connected to the jig at one end of the pivot arm and including means for guiding the opposite end of each pivot arm for movement through an arc, the ends of the cylinder being connected to the respective pivot arms intermediate the ends of the pivot arm.

14. A jig according to claim 13 including a lever arm secured to the cylinder and projecting outwardly and forwardly therefrom.

15. A jig according to claim 1 wherein the back comprises a channel section, with a web thereof providing the flat front surface.

16. A jig according to claim 15 wherein the base comprises a base plate.

17. A jig according to claim 16 wherein the base further comprises a spacer plate below the base plate and forwardly of the notches in the base.

* * * * *